United States Patent [19]

Goulet

[11] Patent Number: 4,854,048

[45] Date of Patent: Aug. 8, 1989

[54] TEMPLATE FOR DRIVER'S DAILEY LOG BOOK

[76] Inventor: Benoit Goulet, 7725 Belcher Rd., Pinellas Park, Fla. 34665

[21] Appl. No.: 177,103

[22] Filed: Apr. 4, 1988

[51] Int. Cl.[4] ..... B43L 13/00

[52] U.S. Cl. ..... 33/443; 33/566

[58] Field of Search ..... 33/443, 474, 562, 566, 33/563; 281/1; 116/235

[56] References Cited

U.S. PATENT DOCUMENTS

| | | | |
|---|---|---|---|
| 382,413 | 5/1988 | Dyer | 33/443 |
| 727,572 | 5/1903 | Bauer | 116/235 |
| 1,155,059 | 9/1915 | Heathcote | 33/474 |
| 2,226,906 | 12/1940 | Henderson | 33/443 |
| 2,230,927 | 2/1941 | Bowman | 33/443 |
| 2,251,845 | 8/1941 | Large | 281/1 |
| 2,814,163 | 11/1957 | Krulwich | 33/32.3 |

*Primary Examiner*—Harry N. Haroian

*Attorney, Agent, or Firm*—Ronald E. Smith; Joseph C. Mason, Jr.

[57] ABSTRACT

A template that facilitates record keeping by commercial bus and truck drivers. A plurality of parallel, elongate slots are formed in the template to guide the driver's marking pen across a page in a log book having preprinted driving periods printed thereon. A larger, vertically extending window member at the right end of the template allows the driver to record total driving hours on the page. The template is clipped to the right end of the page in use and thus also provides a book mark function.

14 Claims, 1 Drawing Sheet

TEMPLATE FOR DRIVER'S DAILEY LOG BOOK

BACKGROUND OF THE INVENTION

1. Technical Field

This invention relates to a device for use by drivers of buses and trucks to enable them, by using a pencil, to make straight lines, pertaining to driving periods, in there driver's daily log.

2. Description of the Prior Art

Templates having utility in connection with the daily log books of commercial drivers were apparently first introduced in the 1930s when the Interstate Commerce Commission began requiring the keeping of such records. E. D. L. Bowman and Benjamin J. Meyers were awarded U.S. Pat. No. 2,230,927 in 1941 for a template that guided a making pen in both horizontal and vertical segments over the pages of a particular type of log book. A. O. Large was awarded U.S. Pat. Nos. 2,215,833 and 2,251,845 in 1940 for a template having a different structure but also capable of guiding a marking instrument in vertical and horizontal segments over the pages of the same type of log book.

Neither one of the early templates have utility in connection with the type of log books now in use. A need exists, therefore, for a template having utility in connection with modern day log books.

SUMMARY OF THE INVENTION

Having traveled all over the United States for twenty years as a commercial driver and having never found a device to assist me in my record keeping, I have used my mind to invent the following practical device.

The longstanding but heretofore unfulfilled need for a template usable with the type of log books now in use is now fulfilled by the present invention. The novel device is of simple design and construction and is easy to use by the driver. It is made of clear plastic, has preferably four parallel, elongate slots formed therein and one vertically extending window means. One end of the template has a return bend formed therein to form a clip means that releasably secures the template to at least one page.

Other objects of this invention will become apparent as this disclosure proceeds.

The invention accordingly comprises the features of construction, combination of elements and arrangement of parts that will be exemplified in the descriptions set forth hereinafter and the scope of the invention will be set forth in the claims.

DETAILED DESCRIPTION OF THE PREFERRED EMBODIMENT

Figure 1:
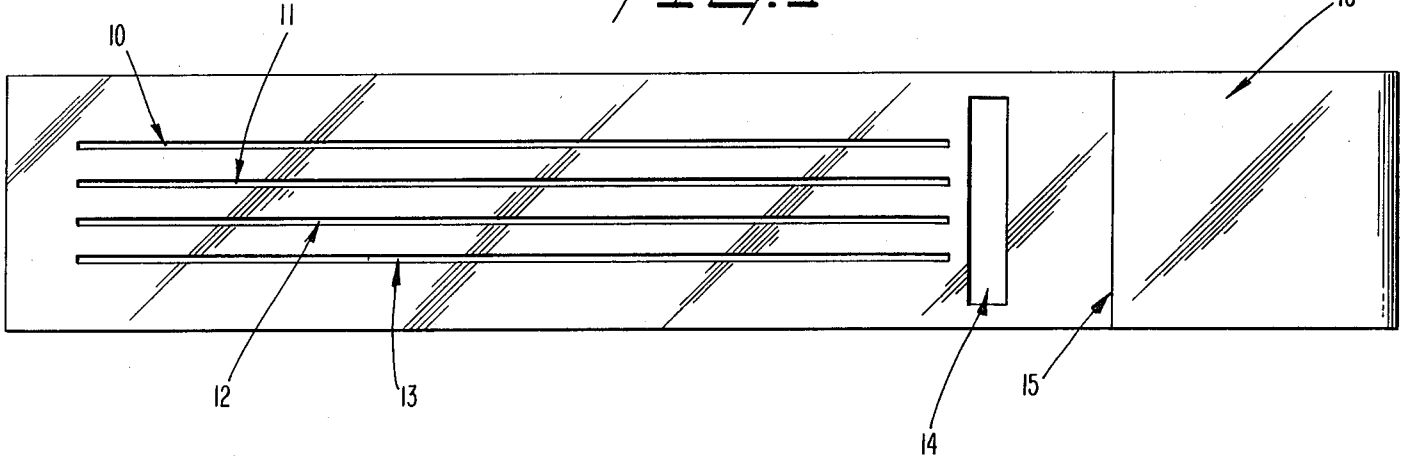
FIG. 1 is a front elevational view of the invention, in an unfolded configuration, showing the position of the slots and the return bend line.

Referring now to the drawings for a better understanding of my invention, it will there be seen that a device embodying the features thereof is indicated in FIG. 1 by the reference numeral.8 as a whole.

Device 8 is formed of a flat, thin, transparent plastic material as shown. Elongate slots 10, 11, 12 and 13 are formed in the plastic material as indicated so as to be directly over the lines printed in the driver's daily log when the device is in use. A vertically extending window means 14 enables the driver to enter information on the log books such as total hours driven during the day. Accordingly, window means 14 has a width sufficient to enable the driver to record double digit numbers on the page.

Figure 3:
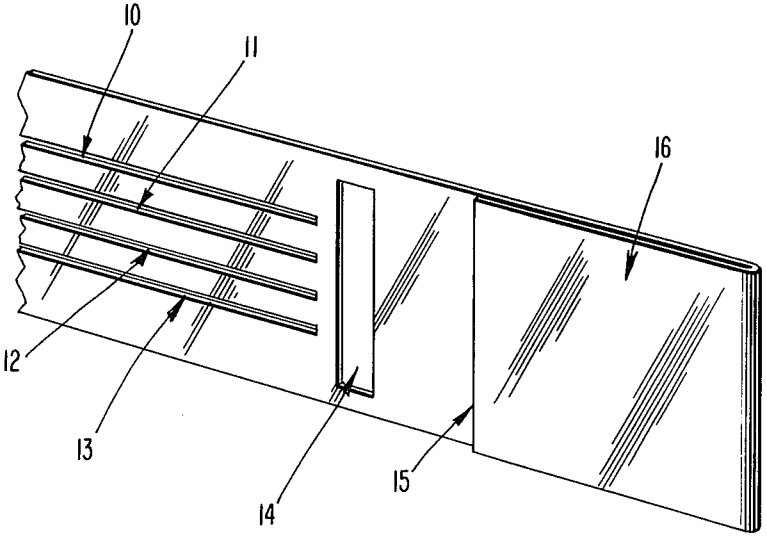
FIG. 3. is a perspective view of a preferred embodiment of my invention.
Figure 2:
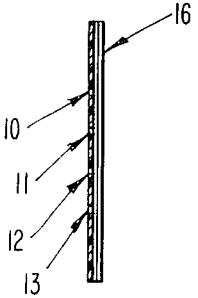
FIG. 2 is an end view taken along line 2—2 in FIG. 1.

Folding line 15 that appears in FIG. 1 is actually a sharp return bend formed in the device as best understood in connection with FIG. 3. The device is never unfolded as depicted in FIG. 1. Thus, the slotted top part of device 8 overlies at least one page in a log book when the device is in use. The unslotted bottom part of the device, i.e., the part thereof to the right of line 15 in FIG. 1, underlies the page being written upon. Thus, it should be clear that one or more pages of the log book are slidably inserted between the two primary parts of the template. More specifically, as best understood in connection with FIG. 3, the right edge of one or more pages of a log book are slidably inserted into the space between the slotted top part of the template and the unslotted bottom part thereof. Accordingly, the page or pages of the log book are clampingly engaged between the two parts of the device 8. In this manner, the template 8 is firmly secured to the page upon which the driver intends to record information. When the log book is closed, device 8 will serve as a book mark so that the same page can easily be found again.

The height or vertical extent of the elongate slots 10, 11, 12, 13 is sufficient to receive the distal free end of the driver's marking instrument, i.e., the elongate slots are specifically dimensioned to receive a point of a pencil and to guide the pencil in a linear path of travel as it traverses the page of the log book in use.

The transparent nature of device 8 enables the driver to position the device in its operative configuration easily. A flexible plastic is the preferred material from which device 8 is constructed, although it could be made of different materials and still perform its intended function.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

I claim:

1. A template for daily log books used by commercial drivers, comprising:

a flat sheet material of predetermined composition;

said sheet material forming a top part of said template;

said top part having a width substantially equal to the width of a page in a driver's daily log book;

a plurality of parallel, elongate slot members formed in said top part for guiding a marking instrument;

said slot members having a length substantially equal to the width of the top part;

a vertically extending window means disposed in orthogonal relation to said elongate slot members;

each of said elongate slot members having a common height dimension sufficient to receive the distal free end of a marking instrument so that said marking instrument free end is constrained by a slot member within which it is inserted to follow a linear path of travel over a page of said log book;

a second flat sheet material forming a bottom part of said template;

said top and bottom parts being integral to one another, and being joined at a sharp return bend.

2. The template of claim 1, wherein said top and bottom parts of said sheet material abut one another when the template is disengaged from a log book page, and wherein said top and bottom parts of said sheet material clampingly engage at least one log book page slidably inserted therebetween.

3. The template of claim 2, wherein said elongate sheet material and said window means are formed in the top part of said template.

4. The template of claim 3, wherein said elongate slot members have a common length.

5. The template of claim 4, wherein said elongate slot members are equidistantly and vertically spaced from one another.

6. The template of claim 5, wherein said sheet material is substantially transparent.

7. The template of claim 6, wherein said top part of said template has a width substantially equal to the width of a page in a log book of a preselected type.

8. The template of claim 7, wherein said sharp return bend is formed at a right end of said template to facilitate its attachment to the right edge of at least one page of a log book.

9. The template of claim 8, wherein said window means is formed in the top part of said template intermediate the common terminus of the elongate slot members and said return bend.

10. The template of claim 9, wherein the width dimension of said window means is sufficiently wide to enable a driver to record double digit information such as total hours driven on a page of said log book, said window means constraining the driver to record the information in a preselected space of said log book that is framed by said window means.

11. The template of claim 10, wherein said template has a rectangular configuration.

12. The template of claim 11, wherein said template is formed of a flexible plastic material.

13. A template, comprising:

a first flat sheet material means having a width substantially equal to the width of a page of a log book;

a second flat sheet material means having a width no greater than the width of said first sheet material means;

said first sheet material means being disposed in overlying relation to a log book page when the template is disposed in an operative configuration;

said second sheet material means being disposed in underlying relation to a log book page when the template is disposed in an operative configuration;

said first and second sheet material means being integrally formed with one another at a sharp return bend so that at least one page of a log book is slidably insertable between said first and second sheet material means and is clampingly engaged therebetween when so inserted so that said template is substantially immovable when clamped to at least one page of a log book;

a plurality of substantially parallel, equidistantly spaced elongate slot members having a common extent being formed in said first sheet material means; and a vertically extending window means formed in said first sheet material means intermediate a common terminus of said elongate slot members and said return bend.

14. The template of claim 13, where said template is formed of a flexible, clear plastic material.

* * * * *